US010049827B2

(12) United States Patent
Thar et al.

(10) Patent No.: US 10,049,827 B2
(45) Date of Patent: Aug. 14, 2018

(54) SWITCHING DEVICE

(71) Applicant: Eaton Electrical IP GmbH & Co. KG, Schoenefeld (DE)

(72) Inventors: Ralf Thar, Sankt Augustin (DE); Ute Molitor, Ramersbach (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/529,088

(22) PCT Filed: Nov. 24, 2015

(86) PCT No.: PCT/EP2015/077473

§ 371 (c)(1),
(2) Date: May 24, 2017

(87) PCT Pub. No.: WO2016/083357

PCT Pub. Date: Jun. 2, 2016

(65) Prior Publication Data

US 2017/0345586 A1 Nov. 30, 2017

(30) Foreign Application Priority Data

Nov. 28, 2014 (DE) ..... 10 2014 117 497

(51) Int. Cl.
*H01H 1/20* (2006.01)
*H01H 1/30* (2006.01)

(52) U.S. Cl.
CPC ..... *H01H 1/2008* (2013.01); *H01H 1/30* (2013.01)

(58) Field of Classification Search
CPC ..... H01H 1/2008; H01H 1/30; H01H 13/00; H01H 13/12; H01H 13/14; H01H 13/20;
(Continued)

(56) References Cited

U.S. PATENT DOCUMENTS 2,840,657 A * 6/1958 Roeser ..... H01H 13/365 200/243
5,075,517 A 12/1991 Spanio
9,312,084 B2 4/2016 Rösch et al.

FOREIGN PATENT DOCUMENTS

CN 103988274 A 8/2014
DE 1154553 B 9/1963
(Continued)

*Primary Examiner* — Anthony R. Jimenez
(74) *Attorney, Agent, or Firm* — Leydig, Voit & Mayer, Ltd.

(57) ABSTRACT

A switching device has a switching chamber; a plate-like switching element, which can be moved in the switching chamber along a linear movement axis (Z) between an ON position in which the switching element connects fixed contacts to one another, and an OFF position in which the switching element is at a distance from the fixed contacts; an actuator for linear movement of the switching element inside the switching chamber; and spring(s) which prestress the switching element in the direction of the movement axis (Z). Guides are provided and configured so the switching element in the switching chamber is guided along the movement axis (Z) in a linearly movable manner and held so a main axis (N) of the switching element, which runs perpendicularly with respect to the two main extension directions (X, Y) of the switching element, is oriented at least substantially parallel to the movement axis (Z).

8 Claims, 2 Drawing Sheets

(58) Field of Classification Search
CPC ..... H01H 13/28; H01H 13/285; H01H 13/30; H01H 13/50; H01H 13/52; H01H 2003/00; H01H 13/02; H01H 13/32; H01H 2205/00; H01H 2221/00; H01H 2221/01; H01H 2221/0152; H01H 1/00; H01H 1/12; H01H 1/14; H01H 1/20; H01H 1/22; H01H 1/221; H01H 1/225; H01H 1/226; H01H 1/24; H01H 1/26; H01H 3/00; H01H 3/02; H01H 3/12
USPC ..... 200/243
See application file for complete search history.

(56) References Cited

FOREIGN PATENT DOCUMENTS

| | | | |
|---|---|---|---|
| GB | 1113546 | A | 5/1968 |
| WO | WO 2012076605 | A1 | 6/2012 |

* cited by examiner

SWITCHING DEVICE

CROSS-REFERENCE TO RELATED APPLICATIONS

This application is a U.S. national stage application under 35 U.S.C. § 371 of International Application No. PCT/EP2015/077473, filed on Nov. 24, 2015, and claims benefit to German Patent Application No. DE 10 2014 117 497.6, filed on Nov. 28, 2014. The International Application was published in German on Jun. 2, 2016, as WO 2016/083357 A1 under PCT Article 21 (2).

FIELD

The present invention relates to a switching device comprising: a switching chamber; a plate-like switching element, which can be moved in the switching chamber along a linear movement axis between an ON position in which the switching element connects fixed contacts to one another, and an OFF position in which the switching element is at a distance from the fixed contacts.

BACKGROUND

Electrical switching devices are components in an electrical circuit that create an electrical connection between fixed contacts ("ON" switching state or "ON" state) or break this connection ("OFF" switching state or "OFF" state). If an electrical connection is to be broken, electricity flows through the contacts connected to one another by means of the switching element until these are isolated from one another.

A switching device is known in the art from WO 2012/076605 A1, for example. The known switching device comprises a switching chamber in which a plate-like switching element can be moved to and fro along a linear movement axis between an ON position and an OFF position. In the ON position, the switching element connects fixed contacts to one another, whereas in the OFF position the switching element is at a distance from the fixed contacts to break the electrical connection. The switching element can be moved in a linear manner inside the switching chamber by actuating means and is prestressed in the direction of the movement axis by means of a spring.

If external forces, such as may arise for example as a result of vibrations during transport, a violent impact against a switch housing or a collision involving the switching device with a hard surface, are applied to the known switching device, the switching element which is prestressed by the spring may slip out of its assembly position. In specific terms, the switching element is accelerated by the externally applied forces, compressing the spring. In this case, the switching element may rotate around its longitudinal axis and tilt in the switching chamber or become jammed between the spring and a wall of the switching chamber. As a general rule, the switching element is unable to slip back of its own accord into its original assembly position from this position, which basically leads to failure of the switching device.

The problem of switching elements tilting in switching chambers is particularly prevalent in the case of low contact forces, as used in control and auxiliary contacts. These are then particularly susceptible to collisions during transport.

SUMMARY

An aspect of the invention provides a switching device, comprising: a switching chamber; a switching element, which can be moved in the switching chamber along a linear movement axis (Z) between an ON position in which the switching element connects fixed contacts to one another, and an OFF position in which the switching element is at a distance from the fixed contacts; an actuator configured to move the switching element linearly inside the switching chamber; a spring which prestresses the switching element in a direction of the movement axis (Z); and a guide configured such that the switching element in the switching chamber is guided along the movement axis (Z) in a linearly movable manner, wherein the guide forms a tilt protection for the switching element so that if forces are applied to the switching device from outside, the switching element can only tilt to such an extent that it cannot be overtilted in the switching chamber or slip beneath the spring, wherein the guide includes a guide body arranged between the spring and the switching element, wherein the switching element is designed in a form of a plate, wherein the guide is configured such that the switching element is held in the switching chamber along the movement axis (Z) such that a main axis (N) of the switching element, which runs perpendicular to both main extension directions (X, Y) of the switching element, is oriented at least substantially parallel to the movement axis (Z), wherein the guide body is substantially plate-like and has an external cross-section corresponding at least substantially to an internal cross-section of the switching chamber, and wherein a plurality of guide elements extend in the direction of the main axis (N) and are arranged on the guide body and protrude on a side of the guide body opposite the switching element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
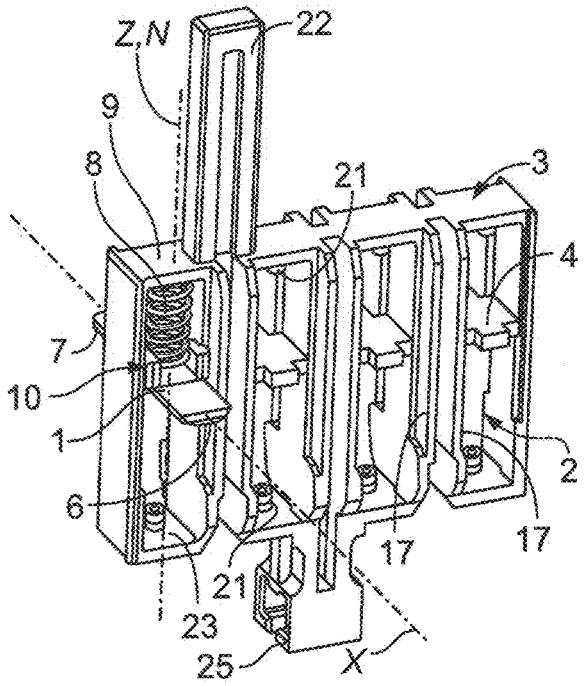
FIG. 1 a perspective view of a switching device according to an embodiment of the invention with a switching element in the assembly position.

An aspect of the present invention provides a switching device that is easy to maintain.

An aspect of the present invention relates to a switching device comprising: a switching chamber; a plate-like switching element, which can be moved in the switching chamber along a linear movement axis between an ON position in which the switching element connects fixed contacts to one another, and an OFF position in which the switching element is at a distance from the fixed contacts; actuating means for linear movement of the switching element inside the switching chamber; and spring means which prestress the switching element in the direction of the movement axis.

An aspect of the invention provides a switching device of the type mentioned at the outset by providing guiding means that are configured such that the switching element in the switching chamber is guided along the movement axis in a linearly movable manner and held such that a main axis of the switching element, which runs perpendicular to both main extension directions of the switching element, is oriented at least substantially parallel to the movement axis.

In other words, the guiding means hold the switching element in an assembly position in which the switching element is able to move to and fro between the ON position and the OFF position in a linear manner and is always prestressed by the spring means. In the ON position, the switching element, which is usually made from an electrically conductive material, creates an electrical connection between the fixed contacts, and in particular two fixed contacts. In the OFF position, the switching element is at a distance from the fixed contacts so that the electrical connection between the fixed contacts is broken. The switching element is held in the switching chamber by the guiding means along the movement axis between the ON position and the OFF position in such a way that the two main extension directions of the plate-like switching element are oriented at least substantially perpendicular to the movement axis. The switching element is designed in the form of a plate so that the length and width of the switching element are understood to be the two main extension directions. The plate-like switching element thus has a comparatively minimal extension in the direction of the main axis compared to the two main extension directions, and this extension can be described as the thickness of the switching element. According to the invention, the main axis of the switching element, which forms a normal line to a plane extending between the two main extension directions, is also oriented at least substantially parallel to the movement axis. The switching element is preferably always held by the guiding means in the assembly position, in which the main axis is oriented parallel to the movement axis. However, the guiding means may also allow the switching element to tilt to some extent in the switching chamber around a longitudinal axis of the switching element, which runs transversely with respect to the main axis. According to the invention, the guiding means ensure that the switching element can only tilt to such an extent that the switching element does not overtilt in the switching chamber or slip beneath the spring means. From this slightly tilted position, in which the main axis runs at least substantially parallel to the movement axis, the switching element returns to the assembly position of its own accord after the vibration and can thus continue to be moved linearly to and fro between the ON position and the OFF position in the switching chamber without any outside intervention.

The invention also makes provision for the tilting angle formed between the main axis and the movement axis to be between 0 and 30°, and in particular a maximum of 10°. This configuration ensures that the switching element is unable to overtilt in the switching chamber and is always able to return to the provided assembly position of its own accord, or in other words without external intervention by a third party. The main axis of the switching element thus runs at least substantially parallel to the movement axis if the tilting angle is between 0 and 30°, and in particular between 0 and a maximum of 10°.

The guiding means are preferably arranged on a side of the switching element facing the spring means. This safely prevents the switching element slipping beneath the spring means. In addition, the guiding means may also provide a holding function for the spring means to hold the spring means in a predefined position with respect to the switching element.

It is also possible for the ratio between an extension of the guiding means in the direction of the main axis and an extension of the switching element in the direction of the main axis to be greater than or equal to 1.5:1. The guiding means may comprise a plurality of means to guide the switching element, it being sufficient for one of the guiding means to have a ratio between an extension of the guiding means in the direction of the main axis and an extension of the switching element in the direction of the main axis greater than or equal to 1.5:1. The guiding means may also comprise precisely one guiding means with the aforementioned ratio of at least 1.5:1. Due to the fact that that it is comparatively thin, in other words with regard to its extension in the direction of the main axis, compared to its length and width, the switching element has only narrow surfaces directed towards the inner walls of the switching chamber on which the switching element could possibly be supported on the inner walls of the switching chamber. To prevent the switching elements tilting inside the switching chamber, the guiding means can thus be at least one and a half times thicker than the switching element. In this case, the thickness of the guiding means is dependent on the structural features of the switching chamber and the thickness of the switching element, as a result of which the guiding means prevent tilting of the switching element and in particular do not obstruct linear movement of the switching element between the ON position and the OFF position. The guiding means are preferably at least three times, or in particular four times thicker than the switching element, or in other words, the ratio between the extension of the guiding means in the direction of the main axis and the extension of the switching element in the direction of the main axis is at least 3:1, or in particular 4:1. The ratio between the extension of the guiding means in the direction of the main axis and the extension of the switching element in the direction of the main axis is preferably a maximum of 5:1.

It is also possible for the guiding means to comprise a guide body, said guide body in particular being arranged between the spring means and the switching element. The guide body may expediently be essentially plate-shaped, the guide body having an external cross section that corresponds at least substantially to the internal cross section of the switching chamber. In other words, the guide body is smaller than the switching chamber so that the guide body can slide along the movement axis. A plurality of guide elements extending in the direction of the main axis are preferably arranged on the guide body. The guide elements preferably protrude on the opposite side of the guide body to the switching element. In addition or alternatively, the guide elements may be arranged on the side of the guide body facing the switching element. In particular, the guiding means are essentially column-shaped and are arranged on the edges of the guide body. Thus, for example, a plate-like guide body may comprise four column-shaped guide elements arranged in the corners of the guide body, said guide elements extending on a side of the guide body pointing away from the switching element in the direction of the main axis of the switching element. The greater the extension of the guide elements in the direction of the main axis, the greater the protection against tilting of the switching element in the switching chamber. In other words, the longer the guide elements, the smaller the maximum tilting angle. The guide elements are preferably designed to be rigid, which further improves tilting protection of the switching element. Another advantageous feature of this embodiment is that the guide elements define a holding area between said elements, in which the spring means, for example a coil spring, are held.

According to a first solution, it is conceivable that the guiding means and the switching element are separate components. This means that known switching devices can be retrofitted with the guiding means according to the invention. The guide body and the switching element are preferably arranged such that they are in surface contact with one another. In this case, the guiding means, and in particular the guide body, may be in contact with the switching element in a non-fixed manner, or connected to the switching element, and in particular glued together.

According to an alternative second solution, it is conceivable that the guiding means may be connected to the switching element. In particular, the guiding means may be an integral part of the switching element.

In particular, the switching device may be one of the components of an electrical switching apparatus having double-break contacts. In particular, the switching appliance may be an auxiliary switch, a circuit breaker, a contactor, or in particular an auxiliary contactor.

FIGS. 1 to 4 show a switching device according to an embodiment of the present invention. The switching device according to the invention is part of an electrical switching appliance having double-break contacts, which known per se and is not illustrated here. In brief, the switching device according to the invention comprises a switching element 1, which can be moved to and fro in a switching chamber 2 along a linear movement axis Z between an ON position, in which the switching element 1 creates an electrical connection between two fixed contacts (not shown) of the switching appliance, and an OFF position, in which the switching element 1 is at a distance from the fixed contacts.

FIG. 1 shows that the switching device comprises a carrier housing 3. The carrier housing 3, which can also be described as a switching bridge, is arranged in the switching appliance such that it can move along a movement axis Z. Four of the switching chambers 2 are arranged next to one another in the carrier housing 3. The switching chambers 2 have the same design and have an essentially longitudinal shape extending along the movement axis Z. The switching chambers 2 are arranged such that they are open on one front side and one rear side of the carrier housing 3. A stop element 4 is arranged inside each of the switching chambers 2, said stop element sub-dividing the respective switching chamber 2 approximately into at least a top third and a bottom two-thirds. The carrier housing 3 is electrically isolated from the switching chambers 2 and may be made from a plastics material, for example.

FIG. 1, by way of example, shows the use of just one single switching element 1 in the left switching chamber 2, although a switching element 1 may in principle be arranged in a plurality of or all switching chambers 2. According to FIG. 4, the switching elements 1 may not only be able to be moved along the linear movement axis Z in the upper third of the switching chamber 2, but also in the lower two-thirds of the respective switching chamber 2. The plate-like switching element 1 has two main extension directions X, Y, specifically in the direction of a longitudinal extension L of the switching element 1 and a transverse extension B of the switching element 1, the longitudinal extension L of said switching element being longer than the transverse extension B of said switching element due to a longitudinal configuration of the switching element 1. Compared to the two main extension directions X, Y, the switching element 1 has a relatively short extension D in the direction of a main axis N, said extension D also being defined as the thickness of the switching element 1. The main axis N is perpendicular to a plane E, which extends between the two main extension directions X, Y and thus represents a normal line from the plane E. When the switching element 1 is in the position shown in FIG. 1, the main axis N and the movement axis Z coincide, or in other words, the switching element 1 is not tilted. This position is the assembly position of the switching element 1, in which the switching element 1 can be moved to and fro along the linear movement axis Z between the ON position and the OFF position. Furthermore, FIG. 1 shows that the switching element 1 protrudes on the open front side and the open rear side of the carrier housing 2 and has contact regions 6, 7 on an underside 5 at both longitudinal ends, said contact regions being in contact with the fixed contacts in order to create the electrical connection in the ON position.

The switching element 1 is prestressed in the direction of the movement axis Z in the switching chamber 2 by a coil spring 8. The coil spring 8 is supported on an upper wall 9 of the carrier housing 3 and guiding means 10, which are arranged between the coil spring 8 and the switching element 1.

The guiding means 10 comprise a plate-like guide body 11, said guide body 11 comprising an external cross section corresponding to the internal cross section of the switching chamber 2, although slightly smaller. The size difference is selected such that the guide body 11 can slide along the movement axis Z in the switching chamber 2. The guide body 11 is in surface contact with an upper side 12 of the switching element 1 opposite the lower side 5 of the switching element 1, said guide body 11 and said switching element 1 forming two separate components. In the assembly position, the guide body 11 and the switching element 1 are in contact with one another in a non-fixed manner, said guide body 11 being pressed against the upper side 12 of the switching element 1 by the coil spring 8.

Figure 2:
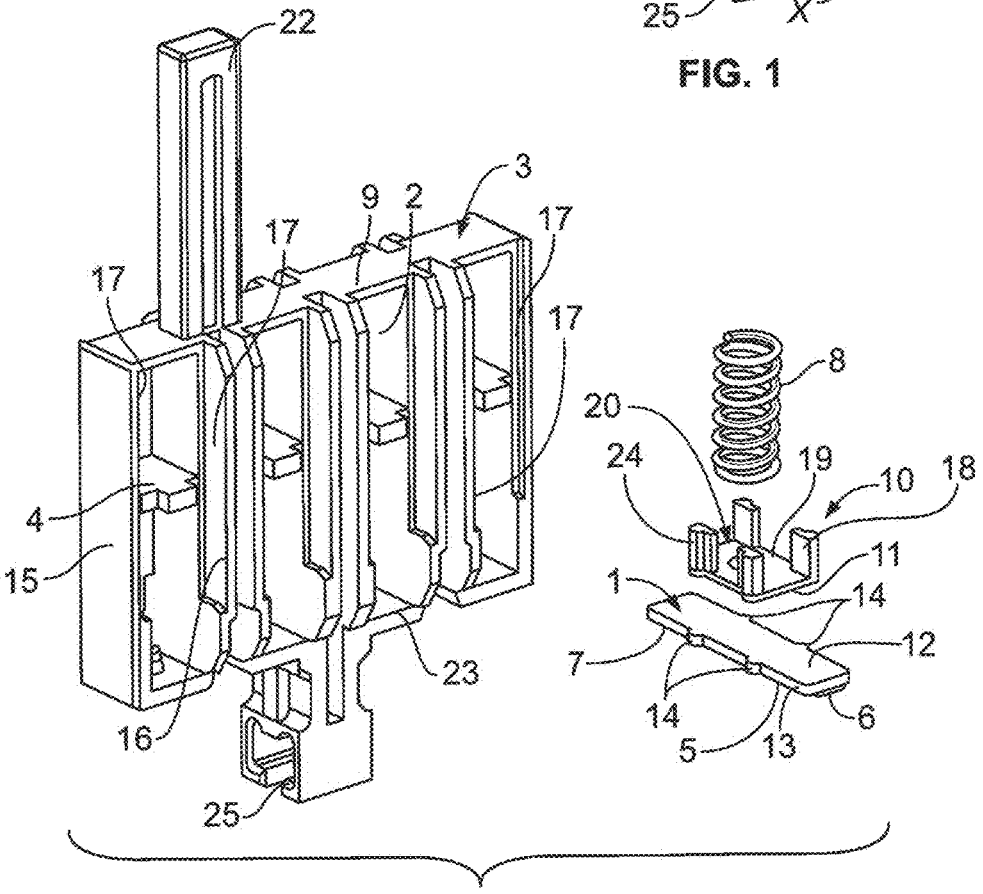
FIG. 2 an exploded view of the switching device shown in FIG. 1.
Figure 3:
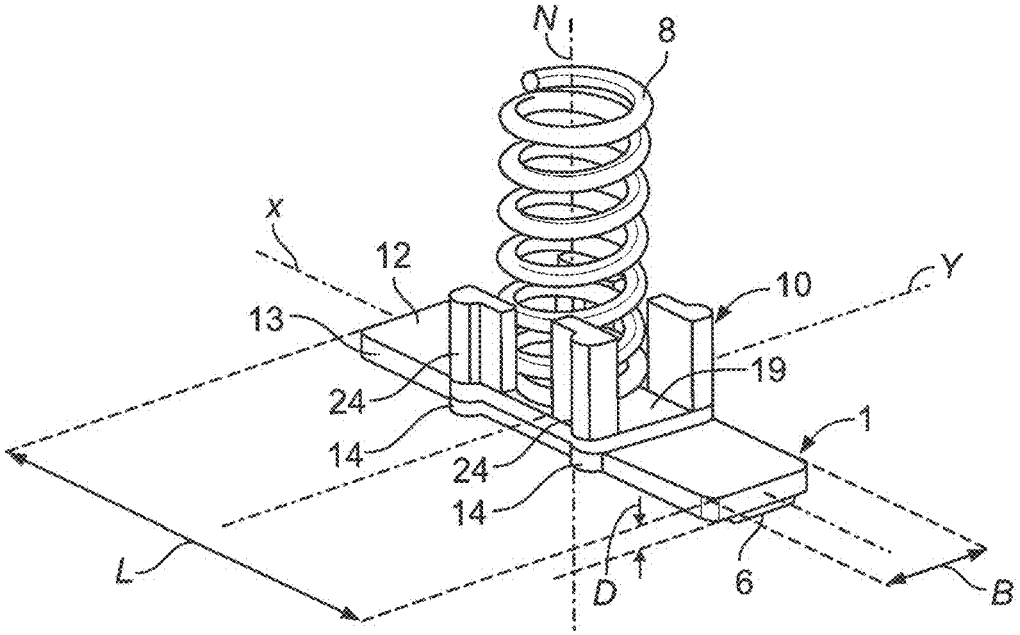
FIG. 3 a partial perspective view of the switching device shown in FIG. 1.

FIG. 2 shows the carrier housing 3, the switching element 1, the guiding means 10 and the coil spring 8 in an exploded view. It can be clearly seen that the switching element 1 has two projections 14 on each of the two opposite side surfaces 13. Corresponding to the projections 14, the carrier housing 3 has two recesses 17 on each side wall 15, 16 extending in the direction of the movement axis Z on the side walls 15, 16 delimiting the switching chambers 2, said projections 17 engaging in said recesses when the switching element 1 is in the assembly position to guide the switching element 1 along the movement axis Z.

As is also shown in FIG. 2, the guiding means 10 comprise four column-shaped guide elements 18 extending in the direction of the main axis N, said guide elements being arranged on an outer surface 19 of the guide body 11 facing away from the switching element 1. The guide elements 18 protrude/are located at four corners of the at least substantially rectangular-shaped guide body 11 such that the projections 14 of the switching element 1 overlap the guide elements 18 when the switching element 1 is in the assembly position, in which the guiding means 10 are arranged between the switching element 1 and the coil spring 8 when viewed in the direction of the main axis N. The sides of the column-shaped guide elements 18 and the guide body 11 facing the side walls 15, 16 of the carrier housing 3 thus form guide surfaces 24 by means of which the switching element 1 is guided along the movement axis Z in the switching chamber 2. In this case, the ratio between an extension of the guiding means 10 in the direction of the main axis N and the thickness D of the switching element 1 is approximately 4:1, which means that the guide surfaces 24 of the guiding means 10 are three times wider than the side surfaces 13 of the narrow switching element 1 in the direction of the main axis N.

Figure 4:
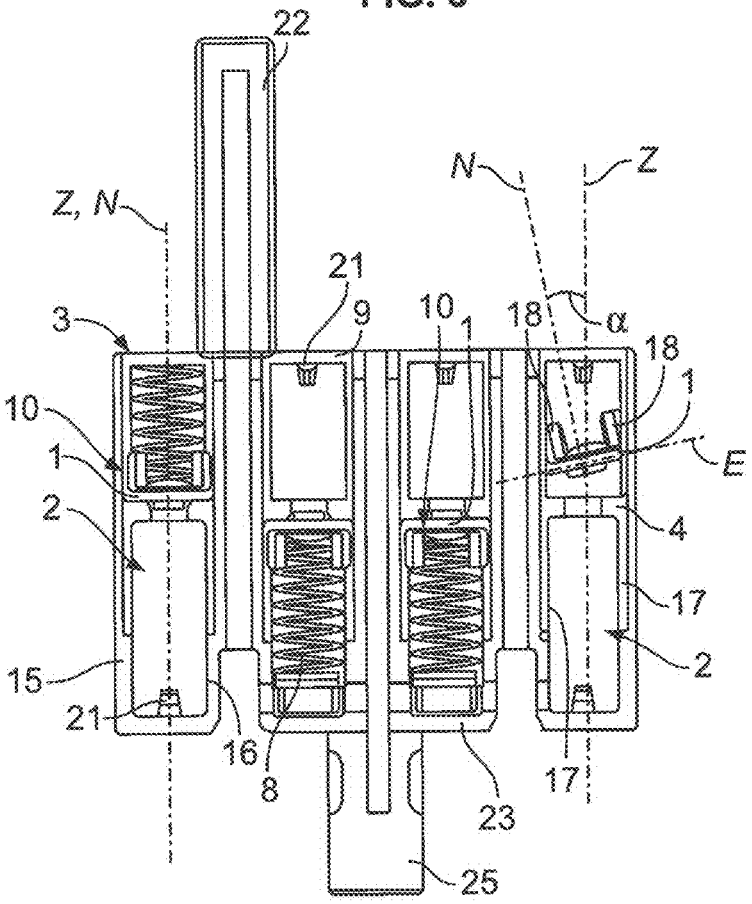
FIG. 4 a side view of the switching device shown in FIG. 1 with four switching elements, three of said switching elements being shown in the assembly position and one switching element being shown in the tilted position.

FIG. 2 shows that a holding area 20 is defined between the column-shaped guide elements 11, said holding area being defined by the outer surface 19 of the guide body 11 at the underside facing the switching element 1. In the assembly position, the coil spring 8 engages in the holding area 20 and is thus held at its longitudinal end facing the switching element 1. This is held at the opposite longitudinal end of the coil spring 8 by a pin 21, s shown in FIG. 4, which is arranged on the upper wall 9 of the carrier housing 3 and protrudes into the switching chamber 2. Each switching chamber 2 is also assigned to a pin 21 on a lower wall 23 of the carrier housing 3, said pins 21 also protruding into the switching chamber 2 to fix a coil spring 8 arranged in the bottom part of the switching chamber 2, as shown in FIG. 4 by way of example.

In order to move the switching element 4 inside the respective switching chamber 2 in a linear manner, the switching device comprises a carrier element 25 arranged on the lower wall 23 of the carrier housing 3, said carrier element being able to be connected to a catch on the switching appliance. A position-indicating device 22 is arranged on the upper wall 9 of the carrier housing 3, said position-indicating device providing a visual indication of whether the switching element is in the ON position or the OFF position.

When the switching device is operational, the switching element 1 is in the assembly position in which the switching element 1 is prestressed against the stop element 4 by the coil spring 8. The main axis N of the switching element 1 is oriented parallel to the movement axis Z in the assembly position shown in FIG. 1. By moving the carrier housing 3 in a linear manner along the movement axis Z via the carrier element 25, the switching element 1 is moved to and fro, or up and down respectively looking at FIG. 1, along the linear movement axis Z between the ON position and the OFF position.

If an external force, which may, for example, be created during transport or due to a collision involving the switching device, is applied to the carrier housing 3, the switching element 1 is prevented from slipping beneath the coil spring 8 by the guiding means 10. FIG. 4 shows that a tilting angle a is formed between the tilted main axis N and the movement axis Z, and this angle is approximately 10° in this instance. The fact that the guiding means 10 have larger guide surfaces 19 than the side surfaces of the switching element 1 prevents the switching element 1 from tilting further beyond the 10° shown and as a result ensures that the switching element 1 will not slip beneath the coil spring 8. In this manner, the switching element 1 is able to assume a maximum slightly tilted position within the switching chamber 2, from which it is able to return to its original assembly position independently, or in other words of its own accord, without any further external intervention.

Unlike the switching device shown in FIG. 1, one of the switching elements 1 is used in each of the three left-hand switching chambers 2 in FIG. 4, by way of example.

The tilted switching element 1 is in this case shown in simplified form in the right-hand switching chamber 2 without the compressed coil spring 9 in this instance, merely to clarify the way in which the tilt protection provided by the guiding means 10 operates.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

1 switching element
2 switching chamber
3 carrier housing
4 stop element
5 underside
6 contact region
7 contact region
8 coil spring
9 upper wall
10 guiding means
11 guide body
12 upper side
13 side surfaces
14 projections
15 side wall
16 side wall
17 recess
18 guide elements
19 outer surface
20 holding area
21 pin
22 position-indicating device
23 lower wall
24 guide surfaces
25 carrier element
B transverse extension
D extension
E plane
L longitudinal extension
N main axis
X main extension direction Y main extension direction
Z movement axis
A tilting angle
The invention claimed is:

1. A switching device, comprising:

a switching chamber;

a switching element, which can be moved in the switching chamber along a linear movement axis (Z) between an ON position in which the switching element connects fixed contacts to one another, and an OFF position in which the switching element is at a distance from the fixed contacts;

an actuator configured to move the switching element linearly inside the switching chamber;

a spring which prestresses the switching element in a direction of the movement axis (Z); and a guide configured such that the switching element in the switching chamber is guided along the movement axis (Z) in a linearly movable manner, wherein the guide forms a tilt protection for the switching element so that if forces are applied to the switching device from outside, the switching element can only tilt to such an extent that it cannot be overtilted in the switching chamber or slip beneath the spring, wherein the guide includes a guide body arranged between the spring and the switching element, wherein the switching element is designed in a form of a plate, wherein the guide is configured such that the switching element is held in the switching chamber along the movement axis (Z) such that a main axis (N) of the switching element, which runs perpendicular to both main extension directions (X, Y) of the switching element, is oriented at least substantially parallel to the movement axis (Z), wherein the guide body is substantially plate-like and has an external cross-section corresponding at least substantially to an internal cross-section of the switching chamber, and wherein a plurality of guide elements extend in the direction of the main axis (N) and are arranged on the guide body and protrude on a side of the guide body opposite the switching element.

2. The switching device of claim 1, wherein a ratio between an extension of the guide in the direction of the main axis (N) and an extension of the switching element in the direction of the main axis (N) is greater than or equal to 1.5:1.

3. The switching device of claim 1, wherein the guide body is in contact with the switching element in a non-fixed manner.

4. The switching device of claim 1, wherein the guide elements are substantially column-shaped and are arranged on edges of the guide body.

5. The switching device of claim 1, wherein the guide and the switching element are separate components.

6. The switching device of claim 1, wherein the guide is connected to the switching element.

7. The switching device of claim 1, wherein the guide elements define a holding area therebetween, in which the spring is held.

8. The switching device of claim 1, wherein the switching element includes at least one projection on each of two opposite side surfaces thereof; the switching chamber includes at least one recess on each side wall thereof, and the projections engage in the recesses so as to guide the switching element along the movement axis (Z) in the switching chamber.

* * * * *